US011542946B2

(12) United States Patent
Turner et al.

(10) Patent No.: US 11,542,946 B2
(45) Date of Patent: Jan. 3, 2023

(54) TWIN-SHAFT PUMPS WITH THERMAL BREAKS

(71) Applicant: Edwards Limited, Burgess Hill (GB)

(72) Inventors: Neil Turner, Burgess Hill (GB); Phillip North, Burgess Hill (GB); Michael Henry North, Burgess Hill (GB); Malcolm William Gray, Burgess Hill (GB); David Alan Turrell, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 183 days.

(21) Appl. No.: 16/624,544

(22) PCT Filed: Jun. 15, 2018

(86) PCT No.: PCT/GB2018/051653
§ 371 (c)(1),
(2) Date: Dec. 19, 2019

(87) PCT Pub. No.: WO2018/234755
PCT Pub. Date: Dec. 27, 2018

(65) Prior Publication Data

US 2020/0124050 A1 Apr. 23, 2020

(30) Foreign Application Priority Data

Jun. 19, 2017 (GB) ..... 1709716

(51) Int. Cl.
*F04C 29/04* (2006.01)
*F04C 29/02* (2006.01)
(Continued)

(52) U.S. Cl.
CPC ..... *F04C 29/04* (2013.01); *F04C 18/123* (2013.01); *F04C 18/126* (2013.01); *F04C 18/16* (2013.01);
(Continued)

(58) Field of Classification Search
CPC .. F04C 29/04; F04C 2240/30; F04C 2240/50; F04C 2240/60; F04C 2240/603;
(Continued)

(56) References Cited

U.S. PATENT DOCUMENTS 6,394,777 B2 * 5/2002 Haavik ..... F04C 29/04 418/94
6,497,563 B1 * 12/2002 Steffens ..... F04C 27/009 418/88
(Continued)

FOREIGN PATENT DOCUMENTS

CN 1656316 A 8/2005
CN 103291616 A 9/2013
(Continued)

OTHER PUBLICATIONS

Translation of Office Action dated Jan. 25, 2021 in CN counterpart Application No. 201880041076.5, 8 pp.
(Continued)

*Primary Examiner* — Mary Davis
(74) *Attorney, Agent, or Firm* — Shumaker & Sieffert, P.A.

(57) ABSTRACT

A twin-shaft pump comprising: a pumping chamber; two rotatable shafts each mounted on bearings is disclosed. Each of the two rotatable shafts comprises at least one rotor element, the rotor elements being within the pumping chamber and the two rotatable shafts extending beyond the pumping chamber to a support member. The support member comprises mounting means for mounting the bearings at a predetermined distance from each other, the predetermined distance defining a distance between the two shafts. A thermal break between the pumping chamber and the support member is provided for impeding thermal conductivity between the pumping chamber and the support member, such that the pumping chamber and support member can be
(Continued)

maintained at different temperatures. The support member and the rotor elements are formed of different materials, a coefficient of thermal expansion of a material forming the support member being higher than a coefficient of thermal expansion of a material forming the rotor elements.

18 Claims, 4 Drawing Sheets

(51) Int. Cl.
*F04C 18/12* (2006.01)
*F04C 18/16* (2006.01)

(52) U.S. Cl.
CPC ..... *F04C 29/02* (2013.01); *F04C 2240/30* (2013.01); *F04C 2240/50* (2013.01); *F04C 2240/60* (2013.01); *F04C 2240/603* (2013.01); *F04C 2270/195* (2013.01); *F05C 2251/04* (2013.01); *F05C 2251/042* (2013.01); *F05C 2251/044* (2013.01); *F05C 2251/046* (2013.01)

(58) Field of Classification Search
CPC ..... F04C 2270/195; F05C 2251/04; F05C 2251/042; F05C 2251/044; F05C 2251/046
See application file for complete search history.

(56) References Cited

U.S. PATENT DOCUMENTS

| | | | | |
|---|---|---|---|---|
| 6,544,020 | B1 | 4/2003 | Bahnen et al. | |
| 8,876,388 | B2 * | 11/2014 | Niwa | F16C 33/14 384/114 |
| 9,175,683 | B2 | 11/2015 | Unami et al. | |
| 2005/0143969 | A1 | 6/2005 | DeMesa et al. | |
| 2005/0254969 | A1 | 11/2005 | Masushige et al. | |
| 2008/0175539 | A1 | 7/2008 | Brown | |
| 2008/0175739 | A1 | 7/2008 | Prior | |
| 2010/0266433 | A1 | 10/2010 | Suzuki et al. | |
| 2013/0309116 | A1 | 11/2013 | Unami et al. | |

FOREIGN PATENT DOCUMENTS

| | | | |
|---|---|---|---|
| CN | 104153991 | A | 11/2014 |
| DE | 102013208829 | A1 | 11/2014 |
| EP | 1533526 | A1 | 5/2005 |
| JP | S63210407 | A | 9/1988 |
| JP | H0717978 | A | 1/1995 |
| JP | H11106343 | A | 4/1999 |
| JP | 2000186685 | A | 7/2000 |
| JP | 2001520352 | A | 10/2001 |
| KR | 10-2014-0134615 | A | 11/2014 |
| TW | 200936885 | A | 9/2009 |
| TW | 201638473 | A | 11/2016 |

OTHER PUBLICATIONS

Translation of the Office Action from counterpart Taiwanese Application No. 107120976, dated Jul. 19, 2021, 3 pp.
International Search Report and Written Opinion dated Nov. 15, 2018 in counterpart International Application No. PCT/GB2018/051653, 12 pp.
Examination Report under Section 18(3) dated Jul. 15, 2019 in counterpart GB Application No. 1709716.3, 3 pp.
Notification of Reasons for Rejection, and translation thereof, from counterpart Japanese Application No. 2020-519187 dated May 30, 2022, 10 pp.

* cited by examiner

TWIN-SHAFT PUMPS WITH THERMAL BREAKS

This application is a national stage entry under 35 U.S.C. § 371 of International Application No. PCT/GB2018/051653, filed Jun. 15, 2018, which claims the benefit of GB Application 1709716.3, filed Jun. 19, 2017. The entire contents of International Application No. PCT/GB2018/051653 and GB Application 1709716.3 are incorporated herein by reference.

TECHNICAL FIELD

The disclosure relates to twin-shaft pumps.

BACKGROUND

The internal surfaces of some pumps may need to be maintained at a high temperature to avoid condensation of process pre-cursors or by-products. Surface temperatures in excess of 220° C. are often desirable. However, other components of pumps may not operate well at such high temperatures.

Bearings' materials for example, can be specially treated to withstand temperatures up to approximately 170° C. without impairing their reliability. The special heat treatment has a cost, and, if the bearing temperature could be reduced to below about 120° C., such treatments would not be required.

It is therefore desirable to isolate the bearings from the high internal temperatures of the pump in order to preserve their reliability. However, with a twin-shaft pump when the pump operates at high temperature, the rotors increase in diameter; if the shafts are mounted on a support member that is maintained at a similar temperature to the rotors then generally the shafts will move apart by the same amount as the rotors expand. If, however, the support member which holds the bearings is maintained at a lower temperature then the axes may move apart by an amount that is less than the growth in the rotor diameter, this will lead either to the rotors touching at high temperatures, or if this is to be avoided, to clearances in the cold condition being increased in order to accommodate the difference. Increased clearances are detrimental to performance and inhibit the pump operating effectively.

It would be desirable to provide a twin-shaft pump where the bearings could be maintained at a lower temperature than the pumping chamber.

SUMMARY

A first aspect provides a twin-shaft pump comprising: a pumping chamber; two rotatable shafts each mounted on bearings; each of said two rotatable shafts comprising at least one rotor element, said rotor elements being within said pumping chamber and said two rotatable shafts extending beyond said pumping chamber to a support member; said support member comprising mounting means for mounting said bearings at a predetermined distance from each other, said predetermined distance defining a distance between said two shafts; and at least one thermal path along structural elements connecting said pumping chamber and said mounting means; a thermal break in at least one of said at least one thermal path for impeding thermal conductivity between said pumping chamber and said mounting means, such that said pumping chamber and support member can be maintained at different temperatures; said thermal break comprising a portion of said thermal path where at least one physical property is different to a physical property of an adjoining portion of said thermal path such that thermal conductance of said thermal break portion is more than 20% lower than said thermal conductance of an equivalent thermal path length of said adjoining portion.

The thermal break in the at least one of the at least one thermal path may comprise a hollow portion of each of said rotatable shafts between said pumping chamber and said bearing.

The ability to maintain different temperature regimes across different parts of a pump can help to provide operational conditions suitable for those different regions such as a high temperature within the pumping chamber and lower temperatures for the bearing locations. The inventors of the present disclosure recognised that such an ability could be provided by inserting a thermal break between the bearing support member and the pumping chamber. Although it is known to try to keep bearings at a reduced temperature compared to the temperature of the pumping chamber, the use of thermal breaks in twin shaft pumps produces its own problems and in particular, problems arising due to differential thermal expansion of the different components.

In this regard, pumps need to be carefully designed and manufactured in order for the moving parts to cooperate with each other accurately. Radial clearances, for example, can result in the moving parts of a pump seizing when they are too small, while when they are too large they can result in poor performance. Differences in thermal expansion between different components of a pump can adversely affect these clearances and may be particularly problematic in twin-shaft pumps where cooperating rotors rotate together. The clearance between the two rotors is affected by the size of the rotor elements and the distance between the shafts. Where the distance between the shafts is fixed by a supporting member at one temperature while the rotors are within the pumping chamber at a significantly different temperature then the clearances between rotor elements may be affected as the temperatures change during pump operation.

Thus, there is a technical prejudice in the field to maintain pumping chambers and the bearings mounting the shafts of a twin shaft machine at temperatures that do not differ too greatly. However, the inventors recognised that in some instances increased clearances may be acceptable and in other instances other features could be used to mitigate for the effects due to temperature differences. Thus, they propose a pump with a thermal break in a thermal path along a structural element, the structural element being any physical element running between the pumping chamber and mounting means for the bearings. The thermal break is made up of a portion of the structural element where at least one physical property is different to a physical property of an adjoining portion of that structural element such that the thermal conductance of that portion of the thermal path is more than 20% lower than the thermal conductance of an equivalent thermal path length of an adjoining portion, preferably more than 30% lower.

The physical property may for example, be the type of material, it may be the thickness of the material, or it may be that it is hollow rather than solid. Thus, a structural element has a portion that is adapted for low thermal conductance in order to provide some thermal isolation between the support member mounting the bearings and the pumping chamber.

In some embodiments, said support member and said rotor elements are formed of different materials, a coefficient of thermal expansion of a material forming said support member being higher than a coefficient of thermal expansion of a material forming said rotor elements.

As noted previously differences in thermal expansion between different components of a pump maintained at different temperatures can adversely affect clearances between rotating parts and may be particularly problematic in twin-shaft pumps where cooperating rotors rotate together. If the rotor temperature increases by more than 200° C. during operation for example, and the bearing housing is thermally isolated from the pumping chamber and/or cooled and only increases by 100° C., then, if all else is equal the rotor diameter will grow by more than twice as much as the increase in separation of the rotor axes. On a machine with 100 mm nominal shaft separation, there would need to be 0.12 mm of clearance to allow for that difference in expansion.

The inventors have addressed this by providing materials with different thermal coefficients of expansion in each of the different temperature regions such that the thermal expansions are harmonised. This harmonisation is provided by the different expansion coefficients which are selected to compensate for the different temperature regimes.

In order for the differences in coefficient of thermal expansion to compensate for significantly different temperature regimes, they will need to have significantly different values. In some embodiments, said coefficient of thermal expansion of said material forming said support member is more than a third higher than a coefficient of thermal expansion of said material forming said rotor elements.

While in other embodiments, said coefficient of thermal expansion of said material forming said support member is more than twice as high as a coefficient of thermal expansion of said material forming said rotor elements.

It should be understood that the thermal coefficient of expansion of the material is selected in dependence upon the expected operating conditions and structure of the pump.

Although the twin shafts may be mounted on any type of support member, in some embodiments, said support member comprises a headplate of said pump.

The thermal break may be configured in a number of ways, in some embodiments, said thermal break comprises a material of a lower thermal conductivity separating regions of said structural element formed of a material of a higher thermal conductivity than the material of the adjoining region.

In some embodiments, said thermal break comprises a material of a low thermal conductivity in a thermal path between said pumping chamber and said mounting means.

The thermal path may be along the housing of the pump and/or it may be along the rotor shafts.

The thermal path along the rotor shafts is reduced by providing a portion of the rotor shafts with a lower thermal conductivity. This is achieved by making the shafts hollow for a portion of their lengths and may be further enhanced by forming a portion of the shafts of a material with low conductivity. The portion that is hollow may not be the portion that contacts the support members as it may be important that the shafts are robust at this point of support.

As noted above one way of providing the thermal break is to use a material of low conductivity in a thermal path between the pumping chamber and the mounting means. This material may comprise a ceramic and in some embodiments, it comprises one or more ceramic separators between the support member and the pumping chamber.

These one or more ceramic separators can be in the form of gaskets and in some embodiments several gaskets may be mounted next to each other with surfaces that comprise protrusions so that the contacting surfaces between the gaskets are reduced.

In some embodiments, said pump comprises a further thermal break, said further thermal break comprising a gap between said support member and an end wall of said pumping chamber.

A gap between the support member and the end wall avoids the support member being heated up by direct contact with the pumping chamber. The gap may be selected in size so as to reduce convection between the two surfaces.

In some embodiments, the pump further comprises temperature control means for controlling a temperature of said support member.

In addition to providing a thermal break between the pumping chamber and the mounting means such that it does not heat up at the same rate or to the same extent as the pumping chamber, temperature control means may also be provided to maintain the support member at a desired temperature.

In some embodiments, such temperature control means is operable to control said temperature of said support member in dependence upon a temperature of said pumping chamber and a ratio of said coefficients of thermal expansion of said material forming said support member and said material forming said rotor elements, said temperature of said support member being controlled to provide an expansion of said rotor elements within said pumping chamber that is substantially the same as an expansion of said support member.

The temperature control means can be used to control the temperature of the support means such that the expansion experienced by the support means is substantially the same as that of the rotor element such that this expansion is compensated for and the rotor elements do not touch when their temperature rises, despite being manufactured with relatively low clearances. In this regard, the temperature control means can determine a temperature of the pumping chamber from temperature sensors mounted therein and can control the support member temperature to be at a certain ratio that is determined by the different thermal coefficients of the support members and the rotor elements. In this way, the thermal expansion within the pumping chamber and support members are controlled in dependence upon each other and problems with differential expansion are avoided or at least mitigated.

In some embodiments, the temperature is controlled such that the expansion experienced by the support means is within 10% of that of the rotor element, preferably within 5%.

In some embodiments, said bearings comprise rolling elements within a housing.

In some embodiments, the pump further comprises a means of supplying a flow of oil sufficient to both lubricate and cool said bearings.

In addition to providing the support member in a temperature region that is lower than the temperature region of the pumping chamber, the bearings may be further protected from high temperatures by cooling them with oil. In this regard, oil may be supplied to bearings to lubricate them and in some cases, additional oil may be used such that in addition to lubricating the bearing some cooling of the bearing is also experienced. If the bearings are provided with some cooling and are maintained at a temperature below that of the support member, then the problems of the bearings being protected from the high temperatures and the problems of differential expansion, due to the support member being at a different temperature to the pumping chamber, can be reduced as the support member will be at a higher temperature than the bearings themselves, although it is still at a lower temperature than the pumping chamber. In this way the difference in temperature between the support member and pumping chamber can be reduced while the bearings are still protected.

In some embodiments, said mounting means comprises recesses in said support member in which said bearings are mounted. In such a case the thermal break is between the support member and the pumping chamber and the mounting means are at substantially the same temperature as the pumping chamber.

In other embodiments, said mounting means comprise housings extending from said support member at a far side of said support member from said pumping chamber, said housings being configured to house said bearings.

A way of maintaining the bearings at a lower temperature than the support member is by housing them at a far side from the pumping chamber extending out of the support member. In such an arrangement a thermal break between the mounting means and support member may allow the bearings to be maintained at a lower temperature than the support member. This arrangement allows the temperature of the support member to more closely follow that of the pumping chamber, so that the clearances between the rotors do not change unduly during operation.

In some embodiments, said housings are separated from said support member by low thermal conductivity separating members.

The bearings may be kept at a low temperature compared to that of the support member by using low thermal conductivity separating members such as ceramic gaskets to thermally isolate the housings from the support member to some extent.

In some embodiments, a length of said shafts is such that said support member is at a predetermined distance from said pumping chamber, said bearings providing radial control of said rotatable shafts being mounted towards at least one end of said rotatable shafts, said pump comprising further bearings for providing axial control of said rotatable shafts, said further bearings being closer to said pumping chamber than said bearings providing radial control.

A further way of providing a differential temperature between the support member and the pumping chamber is to mount it at a distance from the pumping chamber. This requires that the shafts are extended and this can lead to its own problems with the axial thermal expansion of the shafts increasing due to their increased length. This can be addressed by providing axial control of the rotatable shaft at bearings that are located close to the pumping chamber, while the radial control is provided by the bearings that are maintained at the lower temperature remote from the pumping chamber. The axial control bearings will therefore operate at a higher temperature than the radial control bearings and as such bearings that are able to resist such temperature should be selected. In some cases, these bearings are air bearings as these can operate reliably at high temperatures.

In some embodiments, these further bearings are located adjacent to the pumping chamber.

Although the twin shafts may be supported via bearings on one support member, in some embodiments, the pump comprises two support members on either side of said pumping chamber, said rotatable shafts being supported by bearings mounted on each of said support members, and each of said support members being separated from said pumping chamber by a thermal break.

Where the shafts are supported on two support members on either side of the pumping chamber, then these support members may both be provided with thermal isolation and/or temperature control to maintain the temperature difference between the support members and the pumping chamber. Furthermore, they may both be manufactured of a material with a different thermal coefficient to that of the rotor elements within the pumping chamber.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present disclosure will now be described further, with reference to the accompanying drawings.

DETAILED DESCRIPTION

Figure 1:
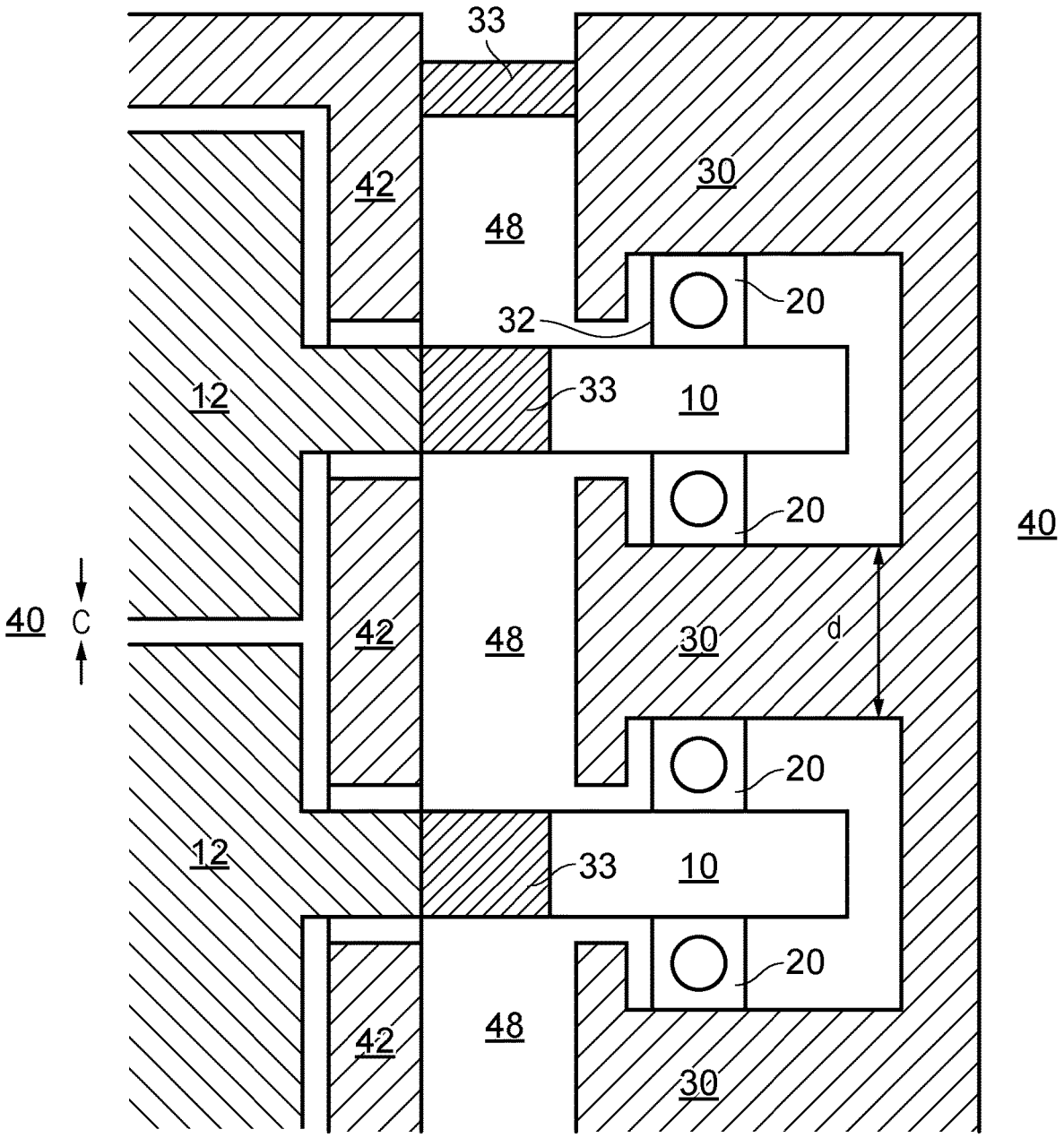
FIG. 1 illustrates one end of a twin shaft pump.

Before discussing the embodiments in any more detail, first an overview will be provided.

It is often desirable to maintain different portions of a pump at different temepratures. Pumping chambers may need to be maintained at a high temperature while bearings and gears may operate better at lower temperatures. Maintaining different portions of a pump at different temperatures results in different portions expanding by different amounts.

In this regard process reliability is the biggest limiting factor for pump life in semiconductor applications. Increasing pump temperature is key to improving this. However, it is preferable that this is not be achieved at the expense of reducing the intrinsic reliability of the machine, and therefore gearbox and bearing temperatures should not be increased with the temperature of the pumping chamber. This leads to differential expansion which unless addressed separately requires additional clearances. These additional clearances may impair the chances of simultaneously achieving low power and good vacuum performance.

The present technique provides a temperature difference between different portions of a pump to provide the desired operating conditions using thermal breaks.

In some embodiments the issues that arise due to different thermal expansion amounts of the different temperature regimes is addressed by using different materials of construction to synchronise thermal expansion at the different temperatures. In this way materials with different coefficients of thermal expansion and different thermal conductivities are selected to allow one portion of a twin-shaft pump to be maintained at a lower temperature than the pumping chamber of the pump while still providing similar expansion to that experienced by the rotor elements within the pumping chamber. This allows the clearances between rotor elements mounted on different shafts in a twin-shaft pump to be maintained substantially constant by configuring the pump such that the rotational axes of the rotors move apart at the same rate as the rotor elements increase in size, despite the difference in temperature changes at the two locations.

In other embodiments these issues are addressed by mounting the bearings in mounting means separated from the support member by a thermal break. In such an arrangement the support member temperature can more closely follow that of the pumping chamber so that differential expansion between the two is reduced. The bearings can however, be maintained at a lower operating temperature.

In preferred embodiments a material with reduced thermal conductance is used to isolate the bearings themselves from the support member that supports them allowing the part of the bearing support between the shaft axes to be at an elevated temperature and thereby expand more, while the individual bearings are at a lower temperature.

In some embodiments, the shaft may be extended such that the bearings can be mounted at a distance from the pumping chamber this distance contributing to the thermal isolation between the bearings and pumping chamber. In such a case the increased length of the shaft may lead to problems with expansion of the shaft. The bearings on which the shafts are mounted provide for both radial control and axial control of the shaft. The increased axial expansion can lead to clearance problems between the rotor and the end of the pumping chamber. Thus, in some cases in order to address this the functions of radial and axial positional control are separated, the axial control being provided in proximity to the pumping chamber so that the effect of axial expansion of the shaft is reduced. A bearing here however, must be able to operate at the high temperatures of the pumping chamber and thus, a bearing that provides axial control is achieved with a non-contacting pressurised air-bearing which can easily be located in a high temperature region. The radial control is a conventional rolling element bearing which is located in a remote, cooler location.

Different positions for the bearings within the structure may be used to provide the desired different operational temperatures provided that there is a low thermal conductance between the bearing and pumping chamber and a means of establishing a thermal gradient. This, when provided in conjunction with a difference in thermal expansivity of the materials in the two temperature zones, allows bearings in a twin-shaft pump to be maintained at a lower temperature than the pumping chamber while the pump can be manufactured with small radial clearances.

FIG. 1 shows a twin-shaft pump according to an embodiment. The pump has two shafts 10 mounted on bearings 20 within recesses 32 in a headplate 30. The shafts 10 each have rotor elements 12 that are located within pumping chamber 40. There is a clearance distance c between the rotor elements. This clearance distance is dependent on the distance d between the bearings 20 mounting the two rotatable shafts 10. As the temperature in the pumping chamber 40 increases the temperature of the rotor elements 12 will increase and they will expand acting to reduce the clearance distance c. If at the same time the headplate's 30 temperature increases then this will expand increasing distance d which acts to move the shafts further apart, acting to increase the clearance distance c. If the pump can be configured such that the increase in the distance d can be set to compensate for the expansion of the rotor elements then the distance c will not change, or at least any change will be reduced.

Figure 3:
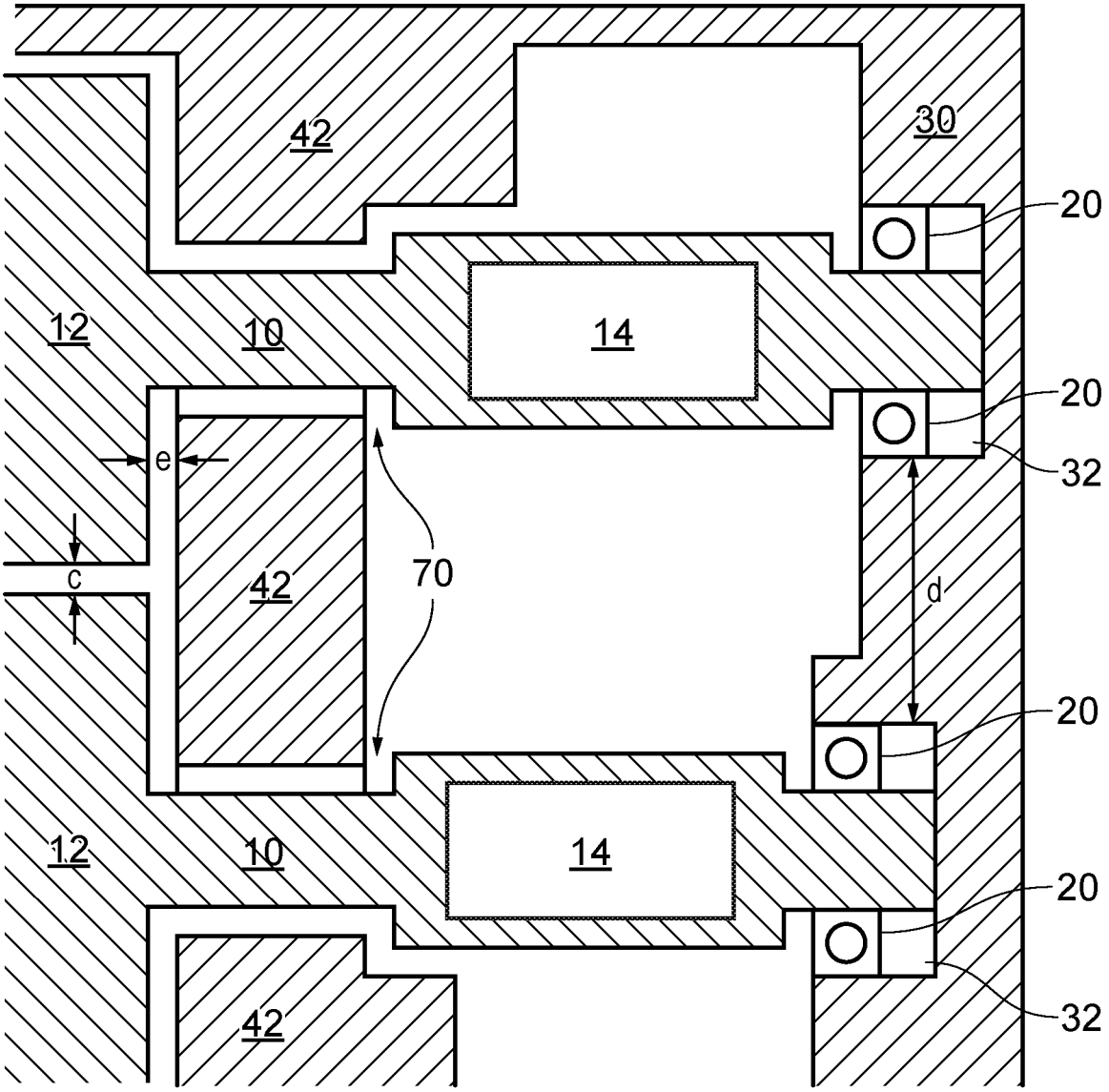
FIG. 3 illustrates a twin shaft pump with extended shafts according to an embodiment.
Figure 4:
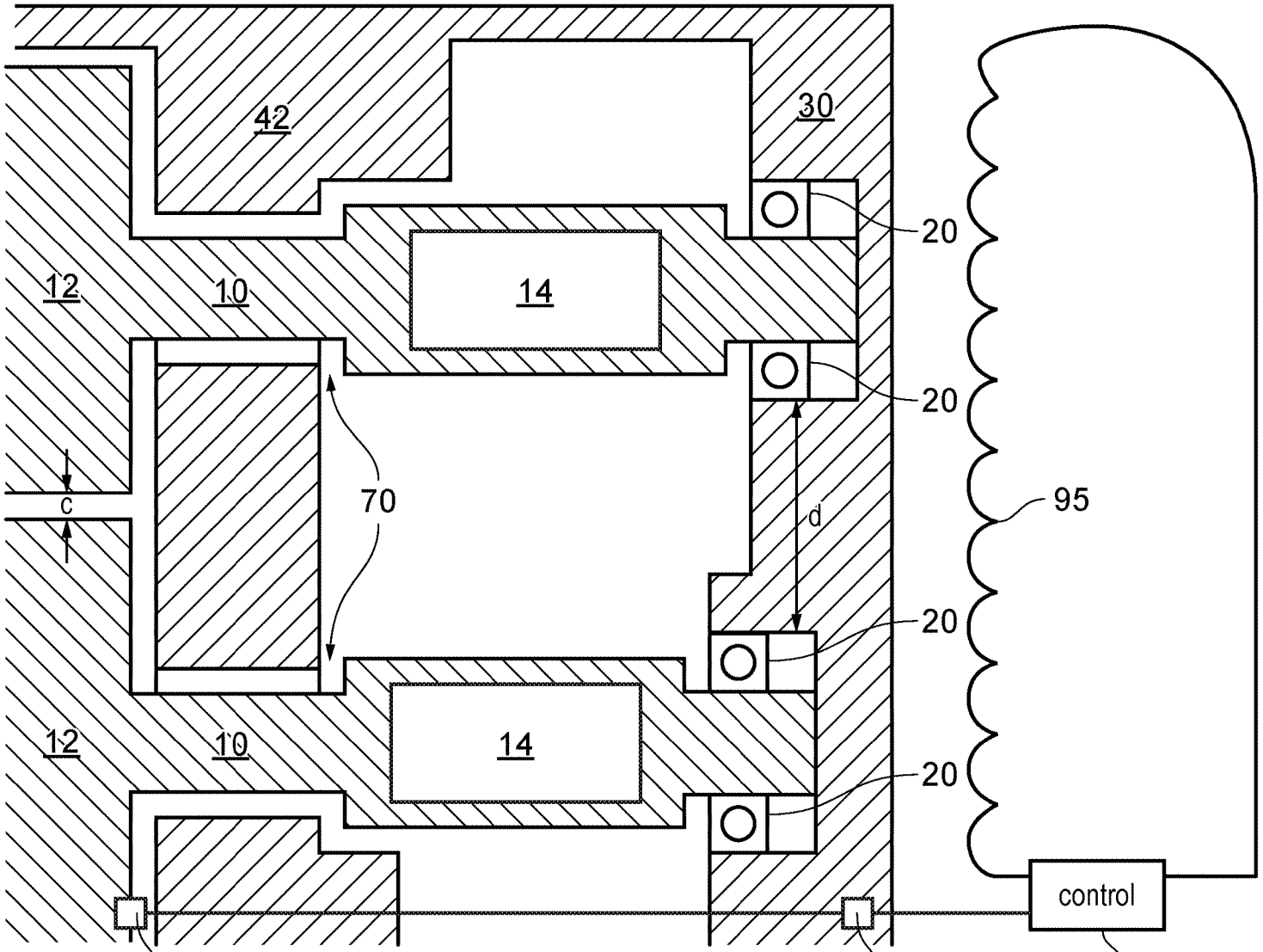
FIG. 4 illustrates temperature control for the bearing housing of a twin shaft pump.

In the embodiment of FIG. 1, the headplate 30 is formed of a metal of high thermal expansivity such as aluminium. The rotor elements are made of cast iron that has a lower thermal expansivity. In this embodiment there is a thermal break 33 between the pumping chamber 40 and headplate 30 to thermally isolate the two to some extent. This thermal break 33 is provided by material of low conductivity within the shafts 10 and between the stator 42 of the pump and the headplate 30 that mounts the shafts 10. There is also an air gap 48 between the headplate 30 and stator 42. In some examples, the shafts may, in addition to having a material of low conductivity, have a portion (not shown in FIGS. 1 and 2) that is hollow, similar to the hollow portions 14 of shaft 10 as shown in FIGS. 3 and 4.

In the example above, the temperature of the region where the bearings are located increases by approximately half the increase in the temperature of the pumping chamber owing to the thermal break. Manufacturing the headplate 30 of a material with a thermal expansion coefficient that is twice that of the rotor material, allows the increase in rotor separation to match the increase in rotor diameter. In this example the rotors are made of cast iron (linear expansivity 1.2×10-5/K) while the bearing housing is made of aluminium (linear expansivity 2.3×10-5/K). The bearing housing is thermally isolated from the pump body by gap 48 and by the material of low thermal conductivity 33. Furthermore, the headplate 30 also has some cooling (not shown) that helps maintain a temperature gradient between these parts. The air gap 48 is sized (i.e. is sufficiently narrow) so as to avoid setting up any significant convective heat transfer between the two parts.

Figure 2:
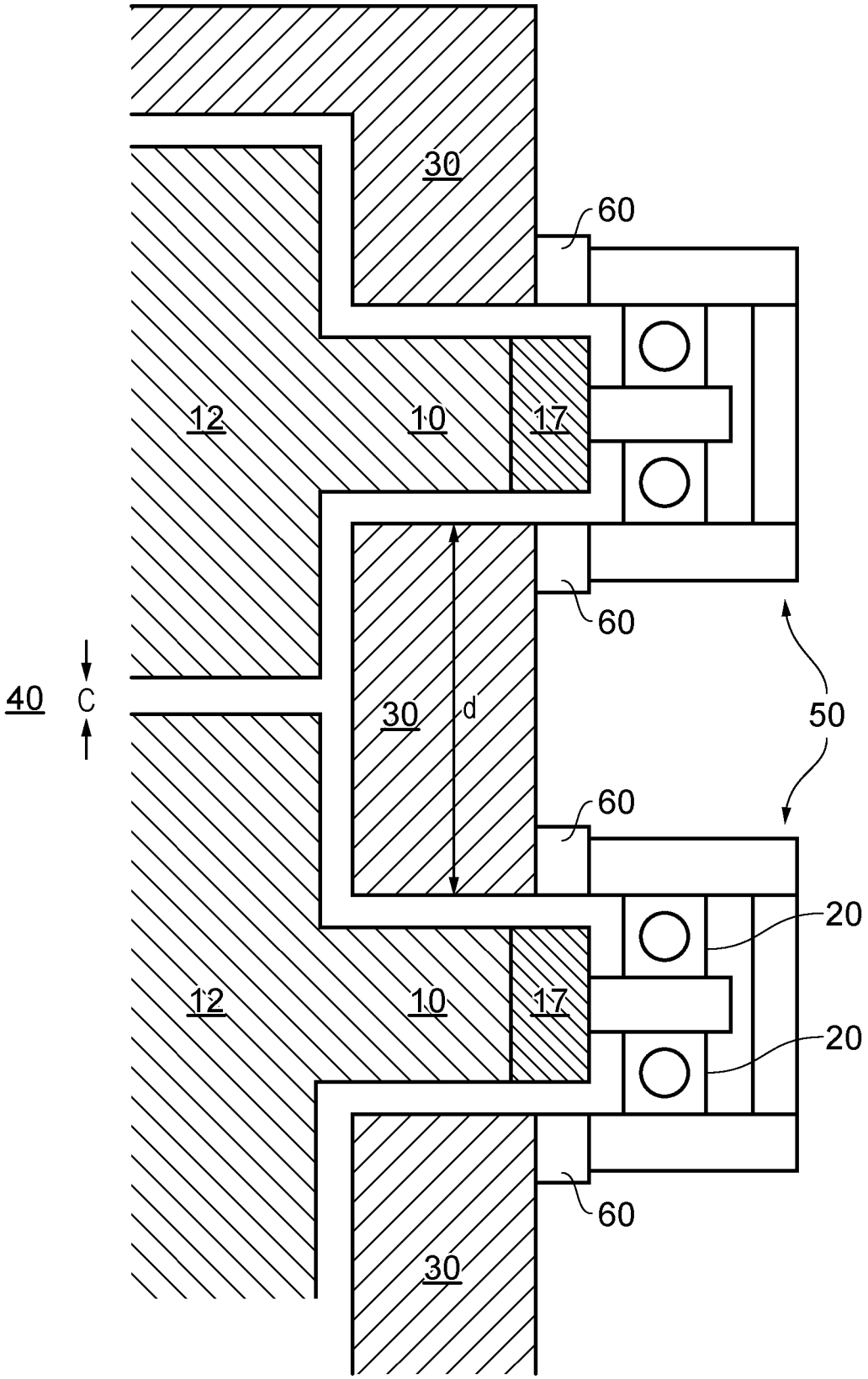
FIG. 2 illustrates housings for bearings supporting the twin shafts of a pump.

FIG. 2 shows a different technique for maintaining a substantially constant distance c between rotor elements during temperature changes within the pumping chamber 40. Here the bearings 20 are housed in housings 50 that are separated from the headplate 30 by a path of low thermal conductance. In this case this low thermal conductance path is provided by inserting a low thermal conductivity material in the form of ceramic gaskets 60 between the elements. The thermal conductivity of this path is further reduced by using a bearing housing 50 that has walls of a thin cross-section. Cooling on the individual bearing housings 50 can also be used to establish a large temperature gradient between it and the headplate 30. If, however, the thermal conductance is reduced enough, then only a small amount of cooling is required and this may be achieved with only the splashing of oil on the bearings 20. There is additionally a portion of the shaft formed of a material of low thermal conductivity 17 which again helps to thermally isolate the bearings from the pumping chamber. As with the example of FIG. 1, in some examples, the shafts 10 of FIG. 2 may additionally have a portion that is hollow, similar to the hollow portions 14 of shaft 10 as shown in FIGS. 3 and 4.

The separation c of the rotor elements 12 is controlled by the expansion of the headplate 30 with associated variations in the distance d, along with the expansion of the rotor elements 12 themselves. In the example shown the headplate 30 holding the shafts 10 is the stator of the high temperature pump and thus, to a large extent follows the temperature of the pumping chamber 40 and thus, its expansion follows the expansion of the rotor elements and the distance c is controlled by this. The bearings meanwhile are maintained at a lower temperature by the thermal break between the pumping chamber and the bearing housing and the cooling of the bearings.

However, in other embodiments the headplate 30 may be maintained at a slightly lower temperature than the interior of the pumping chamber perhaps by being slightly removed from the stator and in such a case a material of a higher thermal expansivity to that of the rotor elements can used for the headplate to compensate for the differences in temperature. In this regard the distance c can be maintained across a large temperature range by a combination of a material forming the headplate 30 of increased thermal expansivity compared to that of the rotor elements 12, and a temperature gradient between the headplate and the bearings, which temperature gradient allows the headplate 30 to be maintained at a higher temperature closer to that of the pumping chamber 40 than the temperature that the bearings 20 are maintained at.

FIG. 3 shows a further embodiment where the required thermal break between the headplate 30 mounting the shaft bearings 20 and the stator 42 of the pump is achieved at least in part by providing an increased distance between the two. Here, the radial location control in the form of bearings 20 is positioned at the far end of the oil box of the pump. However, if the axial control were also located there, then the pump axial clearances would need to be increased to account for the additional length of the shaft between the fixed axial point and the first rotor. Hence, the radial and axial position control functions are separated. The axial control is achieved using an air bearing 70 located adjacent to the pumping chamber 40. The air bearings 70 rely on pressurised air to maintain the distances and can easily operate in a high temperature environment. The radial control seeks to maintain radial clearances such as c, while the axial control seeks to maintain axial clearances shown here as e. The temperature difference between the headplate 30 and the pumping chamber 40 is further increased by the shafts 10 having hollow portions 14 between the pumping chamber 40 and headplate 30.

FIG. 4 schematically shows a system similar to that of FIG. 3, but in this embodiment there is controlled cooling of the headplate 30. Temperature sensors 80 within the pumping chamber and those 82 on the headplate 30 are used as inputs to control circuitry 90 which controls cooling element 95 which acts to cool headplate 30 and maintain an appropriate temperature difference between the pumping chamber 40 and headplate 30. This temperature difference is determined based on a knowledge of the materials of the rotor elements 12 and headplate 30 and is selected such that their relative expansions are similar and the clearance c between rotor elements 12 is maintained substantially constant.

In summary, it is very important for some pumps to operate at very high internal temperatures in order to improve process reliability. This technique enables this and in some embodiments provides a solution that does not require additional clearances that would otherwise degrade the pump performance.

Although illustrative embodiments of the disclosure have been disclosed in detail herein, with reference to the accompanying drawings, it is understood that the disclosure is not limited to the precise embodiment and that various changes and modifications can be effected therein by one skilled in the art without departing from the scope of the disclosure as defined by the appended claims and their equivalents.

The invention claimed is:

1. A twin-shaft pump comprising:

a pumping chamber;

two rotatable shafts each mounted on bearings;

each of the two rotatable shafts comprising at least one rotor element, the rotor elements being within the pumping chamber and the two rotatable shafts extending beyond the pumping chamber to a support member;

the support member comprising mounting means for mounting the bearings at a predetermined distance from each other, the predetermined distance defining a distance between the two rotatable shafts; and at least one thermal path along structural elements connecting the pumping chamber and the mounting means;

a first thermal break and a second thermal break in at least one of the at least one thermal path for impeding thermal conductivity between the pumping chamber and the mounting means, such that the pumping chamber and mounting means can be maintained at different temperatures;

wherein the first thermal break and the second thermal break comprises a portion of the thermal path where at least one physical property is different to a physical property of an adjoining portion of the thermal path such that thermal conductance of the thermal break portion is more than 20% lower than the thermal conductance of an equivalent thermal path length of the adjoining portion; wherein:

the first thermal break comprises a hollow portion of each of the rotatable shafts between the pumping chamber and the bearing, and the second thermal break comprises a material of a lower thermal conductivity than a material forming the adjoining portion of the thermal path and comprises a portion of each of the rotatable shafts between the pumping chamber and the bearing being formed of a material of a lower thermal conductivity than a rest of each of the rotatable shafts.

2. The twin-shaft pump according to claim 1, wherein the support member and the rotor elements are formed of different materials, a coefficient of thermal expansion of a material forming the support member being higher than a coefficient of thermal expansion of a material forming the rotor elements.

3. The twin-shaft pump according to claim 2, wherein the coefficient of thermal expansion of the material forming the support member is more than a third higher than the coefficient of thermal expansion of the material forming the rotor elements.

4. The twin-shaft pump according to claim 2, wherein the coefficient of thermal expansion of the material forming the support member is more than twice as high as the coefficient of thermal expansion of the material forming the rotor elements.

5. The twin-shaft pump according to claim 1, wherein the support member comprises a headplate of the twin-shaft pump.

6. The twin-shaft pump according to claim 1, comprising a third thermal break, the third thermal break comprising a gap between the mounting means and an end wall of the pumping chamber.

7. The twin-shaft pump according to claim 1, wherein the second thermal break comprises a ceramic.

8. The twin-shaft pump according to claim 7, wherein the second thermal break comprises ceramic separators between the mounting means and the pumping chamber.

9. The twin-shaft pump according to claim 1, the twin-shaft pump further comprising temperature control means for controlling a temperature of the support member.

10. The twin-shaft pump according to claim 9, the temperature control means being operable to control the temperature of the support member in dependence upon a temperature of the pumping chamber and a ratio of coefficients of thermal expansion of the material forming the support member and the material forming the rotor elements, the temperature of the support member being controlled to provide an expansion of the rotor elements within the pumping chamber that is substantially the same as an expansion of the support member.

11. The twin-shaft pump according to claim 1, wherein the bearings comprise rolling elements within a housing.

12. The twin-shaft pump according to claim 1, further comprising a means for supplying a flow of oil sufficient to lubricate and cool the bearings.

13. The twin-shaft pump according to claim 1, wherein the mounting means comprises recesses in the support member in which the bearings are mounted.

14. The twin-shaft pump according to claim 1, wherein the mounting means comprise housings extending from the support member at a far side of the support member from the pumping chamber, the housings being configured to house the bearings, and wherein the housings are separated from the support member by low thermal conductivity separating members.

15. The twin-shaft pump according to claim 1, wherein a length of the rotatable shafts is such that the support member is at a predetermined distance from the pumping chamber, the bearings providing radial control of the rotatable shafts being mounted towards at least one end of the rotatable shafts, the twin-shaft pump comprising further bearings for providing axial control of the rotatable shafts, the further bearings being closer to the pumping chamber than the bearings providing radial control.

16. The twin-shaft pump according to claim 15, wherein the further bearings are located adjacent to the pumping chamber.

17. The twin-shaft pump according to claim 15, wherein the further bearings comprise air bearings.

18. The twin-shaft pump according to claim 1, the twin-shaft pump comprising two support members on either side of the pumping chamber, the rotatable shafts being supported by bearings mounted on each of the support members, and each of the support members being separated from the pumping chamber by a thermal break.

* * * * *